United States Patent [19]

Wahl

[11] 4,319,688

[45] Mar. 16, 1982

[54] ADJUSTABLE MARKETING DISPLAY DEVICE

[75] Inventor: Michael Wahl, Roslyn, N.Y.

[73] Assignee: Marlboro Marketing, Inc., New York, N.Y.

[21] Appl. No.: 111,951

[22] Filed: Jan. 14, 1980

[51] Int. Cl.[3] ..... A47F 5/00

[52] U.S. Cl. ..... 211/175; 40/610

[58] Field of Search ..... 211/175, 184, 207; 40/610, 606; 49/55; 160/372, 374

[56] References Cited

U.S. PATENT DOCUMENTS

| | | | |
|---|---|---|---|
| 1,503,018 | 7/1924 | Beechler | 160/374 |
| 2,373,778 | 4/1945 | Quinby | 40/610 |
| 2,631,698 | 3/1953 | Buckwalter | 49/62 |
| 2,987,195 | 6/1961 | Smith | 211/175 |

*Primary Examiner*—Price C. Faw, Jr.

*Assistant Examiner*—Henry E. Raduazo

*Attorney, Agent, or Firm*—Mark T. Basseches; Paula T. Basseches

[57] ABSTRACT

The present invention relates to a marketing display device and is directed more particularly to a restockable display device adapted to be accommodated to a wide variety of marketing locations or configurations as a result of varying the effective length of the display unit and the ability to utilize plural units in side to side conformation which, when assembled, give the appearance of a single monolithic display area. The device is further characterized by portions of the display area being disposed at obtuse angles relative to the back or main marketing panel area whereby a prospective purchaser walking in a path generally parallel to but laterally offset from the display unit or series of units is provided with visual access to a surface or surfaces generally normal to his gaze.

8 Claims, 8 Drawing Figures

ADJUSTABLE MARKETING DISPLAY DEVICE

BACKGROUND OF THE INVENTION

1. Field of the Invention

The present invention is in the field of display devices and pertains more particularly to a point-of-purchase display device adapted to be stocked with a plurality of different articles in such manner that they are visually accessible and readily available for selection and removal by a prospective purchaser.

2. The Prior Art

It is known to provide display devices which comprise generally dispenser means, such as pegboards carrying a plurality of hooks on which articles to be sold are supported. Heretofore pegboards have been affixed to struts, shelves or framework secured to structural components of the selling area. Alternatively, pegboards have been mounted on pedestals which may be shifted to different locations within a selling area.

Where the pegboard is permanently emplaced, it is obvious that proposed modifications of the selling area mandate structural changes if the location or configuration of the display is to be changed. Pegboards mounted on pedestals typically leave an overall impact of a temporary, unimpressive and unimportant installation not conducive to the sale of prestigious or relatively expensive products.

Additionally, in merchandising displays of the type heretofore known, it is necessary, in order to derive an accurate impression of the merchandise being sold, for a prospective purchaser to be at a location essentially opposite the unit, i.e. a purchaser approaching but not yet reaching such display will derive no meaningful appreciation of the wares exhibited.

SUMMARY OF THE INVENTION

The present invention may be summarized as directed to a display merchandising device adapted to support, for removal by prospective purchasers, a variety of prepackaged articles, such as, by way of example, lip sticks, compacts or the like, the device being particularly suitable to the merchandising of so-called "carded" products.

The device is characterized in that it gives the appearance of a substantial and permanent installation and yet is portable. Moreover, the device may be lengthwisely extended or contracted within a range and a plurality of units may be connected or coupled to one another to provide the appearance of a monolithic, integral and permanent display wall.

The individual unit in accordance with the device is comprised of a pair of vertical, self-supporting stanchions, each of which stanchions includes a back wall, a side wall perpendicular to the back wall, and a front wall sloping at an acute angle from the apex or terminal end of the side wall toward the back wall.

The rear of each of the stanchions is notched or recessed, the stanchions of a given unit being arranged in opposed relationship, i.e. as mirror images of each other, with the notches of the stanchions aligned in coplanar orientation.

In addition, each stanchion includes a panel section extending toward the other stanchion, which panel sections may include a pegboard or like display area.

A connector section is disposed between a pair of the stanchions, the connector section including a central panel in partial overlapping relation of the panels carried by the stanchions.

Clamp means are provided which lock the panels in a selected relatively overlapped position so as to permit variation of the effective length of the display unit.

The connector section includes, in addition, a base portion and a facia which extend forwardly of the panels and which ride within notches of the stanchions. Varying of the overlap of the panels, as noted above, is accompanied by a concomitant variation of the adjusted position of the base and facia within the respective notches at the upper and lower ends of the stanchions, whereby there is provided an attractive, sturdy and lengthwisely adjustable display unit.

An important feature of the invention lies in the angular orientation of the front walls of the stanchions which themselves constitute display panels, which angular orientation provides for visual access to articles displayed on such panels to persons walking along an aisle defined by one or more of the display units even in advance of reaching the units.

A further important feature of the invention lies in the ability to connect a plurality of units in side to side relation whereby there may be formed a wall comprised of a series of such devices which nonetheless looks like a monolithic or integral structure due to the interfit of the base and facia with the stanchions, as above described, and also to the fact that abutting structures incorporate front wall portions which meet at an apex defined by their points of convergence.

It will be recognized from the above that a plurality of side to side attached subunits, by virtue of the lengthwise adjustability of each of the units, may be used to span any desired space and even to define a wall or aisle configuration.

It is accordingly an object of the invention to provide a display device which may be shipped knocked-down and readily set up at the job site, which may be lengthwisely extended, and which may be connected to a series of similar units to span any selected selling area.

It is a further object of the invention to provide a device of the type described wherein the display surface of each unit comprises, in essence, a three-sided configuration, namely, a back display area and a pair of forwardly directed display areas, the included angle between the back area and front display areas being an obtuse angle, e.g. about 120°, whereby a product disposed on the angularly oriented panels will be visually accessible to a purchaser even before reaching a position opposite a given display unit.

A further object of the invention is the provision of a device of the type described which, while easily portable, gives the impression of substantiality and permanence, yet nonetheless provides an element of lengthwise adjustability.

To attain these objects and such further objects as may appear herein or be hereinafter pointed out, reference is made to the accompanying drawings, forming a part hereof, in which.

Figure 1:
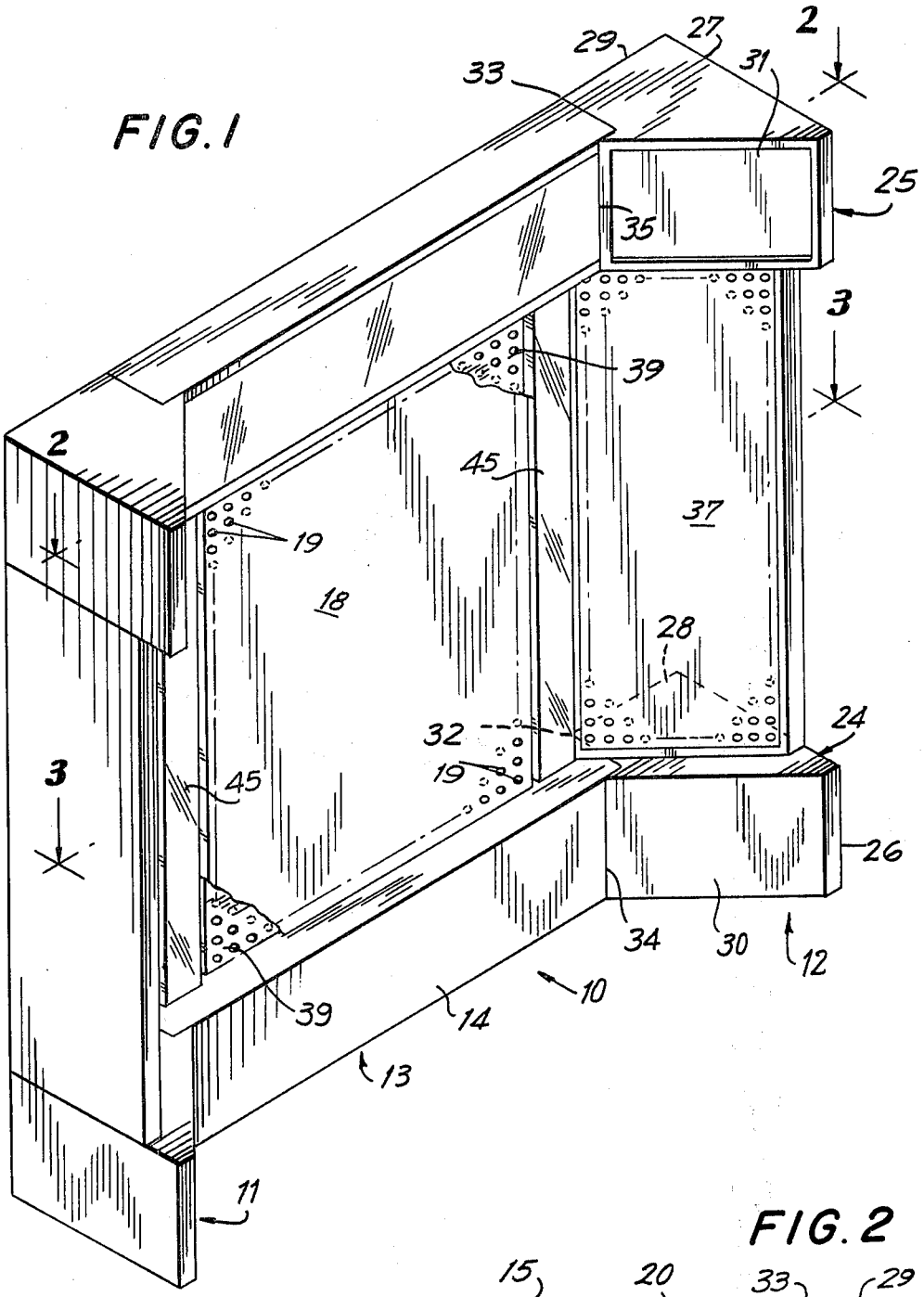
FIG. 1 is a perspective view of a single display unit.

Turning now to the drawings, there is disclosed a display unit 10 comprising a pair of stanchions 11, 12, and a connector section 13. Without limitation, it is preferred that the stanchions may be comprised of injection molded polymeric material internally reinforced to provide structural and dimensional stability and rigidity.

The connector section 13 includes a base portion 14 which may be rectangular in vertical section and, for lightness, is hollow.

A facia section 15, which is preferably of identical size to the base section 14, is supported above the base section 14 by a central reinforcing panel assembly 16 extending vertically between the facia and base.

Optionally but preferably, the reinforcing panel 16 may be formed separately from the base and facia and subsequently attached thereto by any conventional means, such as bolts, stud and socket interfits, or combinations thereof (not shown).

The particular method of assembly of the panel assembly 16 to the base and facia forms no part of the present invention and, accordingly, further details thereof need not be mentioned. It is sufficient to note that the panel assembly 16 includes forwardly directed mounting flanges 17 adapted to support a central display panel 18, preferably a pegboard panel or variation thereof, which includes a multiplicity of regularly spaced-apart apertures, e.g. 19, within which apertures pegboard hooks or equivalent mechanisms may be mounted.

Figure 2:
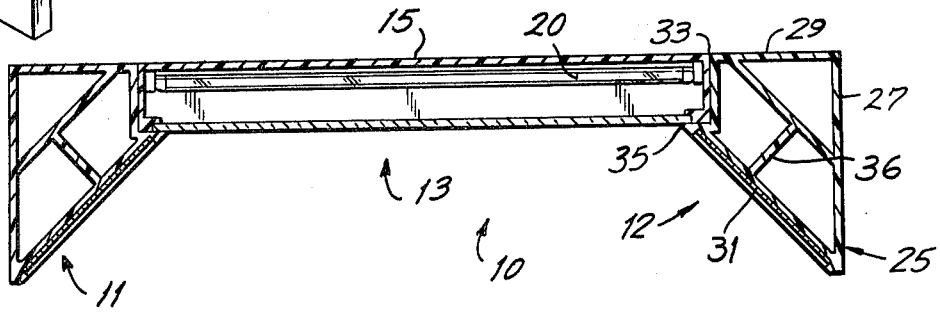
FIG. 2 is a section taken on the line 2—2 of FIG. 1.

As best seen in FIG. 2, the facia 15 may include an illuminating fixture 20, such as a fluorescent bulb element or the like.

Figure 3:
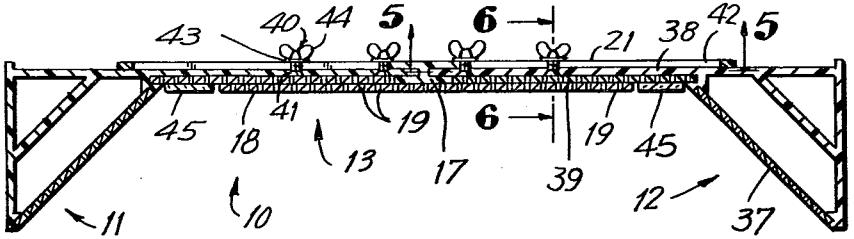
FIG. 3 is a section taken on the line 3—3 of FIG. 1.
Figure 4:
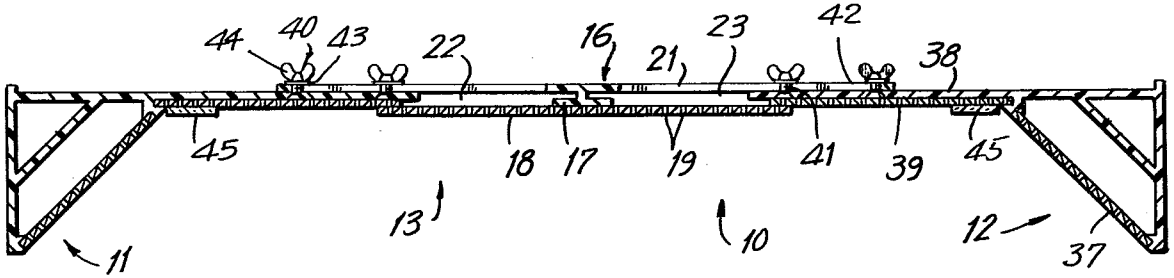
FIG. 4 is a view similar to FIG. 3 showing the position of the parts in the extended or elongated condition of the display unit.
Figure 5:
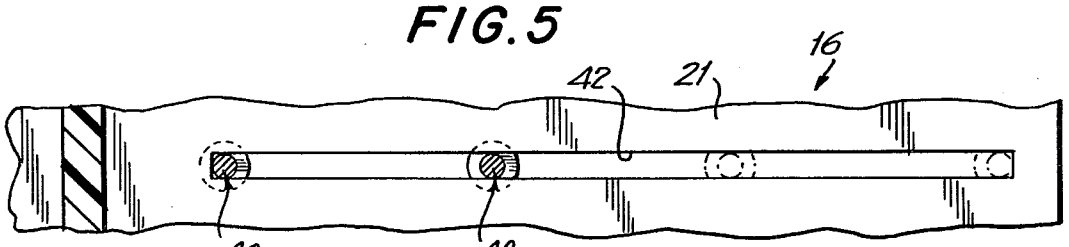
FIG. 5 is a magnified section taken on the line 5—5 of FIG. 3.
Figure 6:
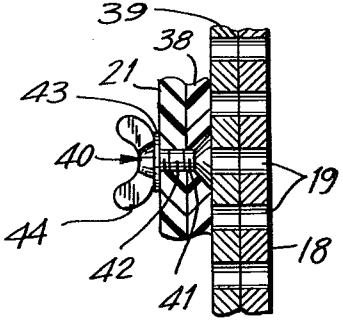
FIG. 6 is a magnified section taken on the line 6—6 of FIG. 3.

As best noted from FIGS. 3 and 4, the display panel 18 is spaced forwardly of a back panel 21 forming part of the structural panel assembly 16, such construction providing laterally open spaces or channels 22, 23 running essentially the entire height between the base and facia.

The stanchions 11 and 12 which interconnect with the connector section 13 are essentially identical except that they are mirror images of each other, (i.e. allochiral). Accordingly, a description of one will suffice for an understanding of both.

The stanchions include a foot portion 24 and a header portion 25. The portions 24 and 25 include side walls 26, 27, respectively, and rear walls 28, 29, respectively. The foot and header portions 24 and 25 also include front walls 30, 31, respectively, which extend angularly rearwardly toward the plane of the rear walls 28, 29, the front walls 30, 31 defining an acute angle of about 30° to 40° with the side walls 27, 28 and, hence, an obtuse included angle of about 120° to 130° with the plane of the rear walls 28, 29.

Notch portions 32, 33 are formed in the foot and header portions 24, 25, respectively, rearwardly of the forward walls 30, 31, respectively. The depth of the notch portions 32, 33 is such as to provide room for the base 14 and facia 15 therein, whereby the relative overlap of the base and facia within the noted notches may be varied within a range.

By virtue of the fact that the rearmost ends 34, 35 of the front walls 30, 31 engage intimately against the front face of the base and facia, respectively, it will not be apparent to one observing the display surface in the direction depicted in FIG. 1, i.e. from the front, that the stanchion is not a permanent and integral part of the base and facia, i.e. the fact that the respective components may be axially shiftable cannot be seen since the relative position of the base in the lower notch 32 is concealed against anyone not behind the structure and the adjusted position of the facia within the notch 33 will be apparent only to one standing above or behind the fixture.

The foot and header portions 24, 25 are connected by vertically directed internal bracing 36 to provide a rigid construction.

The stanchions, at a level between the foot and header portions, include a vertically directed display panel 37 which is preferably formed of pegboard or like material, permitting adjustable mounting of dispenser mechanisms, such as hooks, etc. The panel member 37 may be glued or otherwise affixed in position.

In addition, each of the stanchion members includes one or more horizontally directed support struts 38, the struts 38 of each of the respective stanchions being directed toward the other at coordinated heightwise positions.

To the front face of the struts 38 there is mounted a vertically directed dispenser panel 39 which, like the other panels, is made of pegboard or similar material adapted to support dispenser hooks.

A plurality of threaded lock studs, e.g. 40, are mounted in horizontally spaced apertures 41 on the support struts 38. The shank portions of the lock studs 40 project rearwardly through elongate horizontal slots 42 formed in back panel 21. The combined thickness of the struts 38 and the panel 39 is such as to fit intimately within space 23 defined between the central panel 18 and the back panel 21.

The studs 40 have washers 43 and wing nuts 44 mounted thereon adjacent the rear surface of the panel 21.

It will be thus understood that the struts and panel 39 of the respective stanchions may be slidably, lengthwisely adjusted within the respective spaces 22, 23 by loosening the nuts 44, longitudinally shifting the component parts until a desired spacing of the stanchions is achieved, and thereafter tightening the nuts.

The sliding movement noted is accompanied by varying of the relative overlap position between the panel 18 and the panels 39. As previously noted, the approach and spreading of the respective stanchions within a range will not expose any of the end portions of the facia or base by virtue of the sliding disposition of the ends of the base and facia within the notches formed in the foot and header members 24, 25.

Optionally but preferably vertically extending mirror oortions 45 may be supported on the panels 39 immediately adjacent the connection of the panels to the stanchions.

Figure 7:
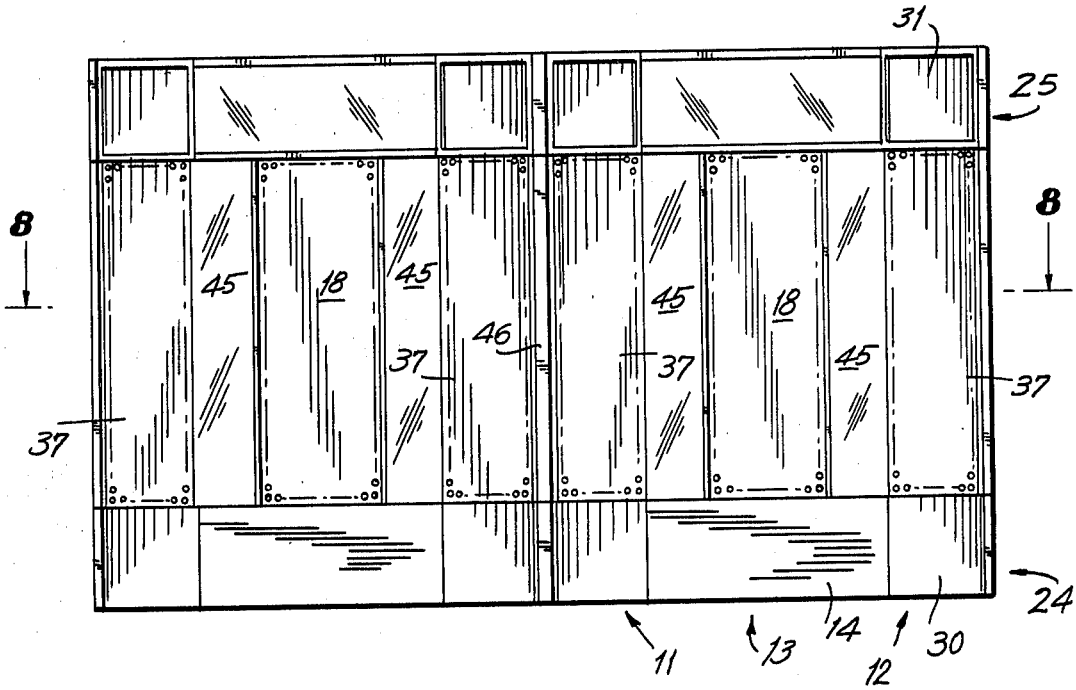
FIG. 7 is a front elevational view of a pair of units interconnected into a single display.
Figure 8:
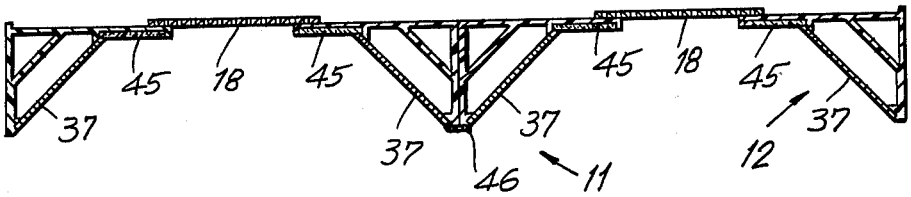
FIG. 8 is a section taken on the line 8—8 of FIG. 7.

As shown in FIGS. 7 and 8, two or more of the previously described units may be connected in side to side fashion to define a unit having the appearance of a single monolithic structure. Optionally, this impression may be heightened by securing a vertically directed concealing strip 46 over the forwardly directed junction of the side walls of adjacent units. The strip 46 may be of only limited width due to the convergence to an apex of the panels 37 of abutting units.

Manifestly there is no limit to the number of units which may be assembled side to side.

Normally the exposed faces of the facia and headers may include advertising displays or other informational material.

As will be apparent from the preceding description, there is disclosed in accordance with the invention a merchandising display unit which is inexpensive to construct, attractive, longitudinally adjustable and capable of connection to one or more similar units to provide the appearance of a monolithic or integral display wall.

The device is characterized particularly by a pair of stanchions and a central section, each of which includes forwardly facing pegboard or like display surfaces, the pegboard of the connector section overlapping the pegboard components of the stanchion sections whereby the length of the device may be modified by a variable overlap of the pegboards.

Due to the fact that the pegboard components have regularly spaced-apart apertures, the break or separation between adjacent overlapping sections is unobtrusive, giving the appearance of a permanent installation rather than a portable or variable structure.

In similar fashion, the impression of permanence is heightened by the sliding interfit between the stanchions and the base and facia provided by the noted constructions hereinabove described.

A particular feature of the device resides in the angled dispenser walls which provide visual access to prospective purchasers walking in a plane parallel to but offset from the principal display panels of the device. The angular panels noted in addition enable the connection of adjacent units in such manner that the monolithic or integral appearance is heightened.

Having thus described the invention and illustrated its use, what is claimed as new and is desired to be secured by Letters Patent is:

1. A lengthwisely adjustable marketing display device comprising, in combination, a pair of vertical end stanchions constituting mirror images of each other and arrayed in spaced opposed relation, each said stanchion including at its upper and lower distal ends a rear wall, a vertical outer side wall perpendicular to said rear wall, a vertical front wall extending from the front of said stanchions toward the rear thereof at an acute angle relative to said side wall, said front wall terminating in a plane forward of said rear wall, said stanchions, between the rearmost end of said front wall and said rear wall, defining a notch configuration extending in a direction parallel to said rear wall, said stanchions being arranged with their front walls converging in a rearward direction and with said notches in coplanar alignment, a connector section disposed between said stanchions, said connector section including a base portion and a facia portion in vertically spaced parallel relation to said base portion, the distal ends of said connector section being slidably disposed within said notches of said stanchions whereby the spacing of said stanchions may be varied in accordance with the relative adjusted position of said connector section within said notches, said connector section between said facia and said base including a vertically directed central display panel connected between said base and facia, each of said stanchions including a vertical dispenser panel disposed in partial overlapping position of said central panel, and clamp means interposed between said connector section and each of said stanchions for locking said dispenser panels in a selected overlapped position relative to said central panel and locking said distal ends of said connector section at a selected position within said notches, thereby adjustably to control the longitudinal extent of said device.

2. A display device in accordance with claim 1 wherein said stanchions include vertically directed display wall portions paralleling said angular front wall portions.

3. A device in accordance with claim 2 wherein said display wall portions define with said dispenser panels an included angle of about 120° to 130°.

4. A marketing display assembly comprising at least two marketing display devices in accordance with claim 1, said display devices being interconnected with the outer portions of side walls of adjacent display devices in abutting relation.

5. A marketing display assembly comprising a plurality of marketing display devices connected in side to side relation to define an elongate marketing display array, each said display device comprising a pair of stanchions and a connector section disposed between and connected to said stanchions, said connector section including a central display panel, said stanchions including dispenser panels in partial overlapping relation of said central display panel, side walls perpendicular to said dispenser panels and angular panels extending from the forwardmost edge of said side walls to said dispenser panels and defining therewith an obtuse included angle, lengthwise adjustment means connecting said stanchions and connector section for holding said central display panel and said dispenser panels in variably overlapping position, thereby to adjust the effective length of said display devices and hence the overall length of said assembly, and means interconnecting the abutting side walls of adjacent said devices.

6. A device in accordance with claim 5 wherein the connector section of each said display device includes a facia and a base portion at the upper and lower extremities, respectively, of said central display panel, said stanchions including upper and lower notch means at the rear faces thereof adjustably slidably receiving the distal ends of said facia and base portion, respectively.

7. A device in accordance with claim 6 wherein said obtuse angle is substantially 120°.

8. A device in accordance with claim 7 wherein the side walls of adjacent sections converge to an apex, the device including a cover strip overlying the adjacent abutting edges of said side walls defining said apex to conceal the junction between said walls.

* * * * *